US011548278B2

(12) United States Patent
Sugiura

(10) Patent No.: US 11,548,278 B2
(45) Date of Patent: Jan. 10, 2023

(54) LIQUID DISCHARGING HEAD

(71) Applicant: Brother Kogyo Kabushiki Kaisha, Nagoya (JP)

(72) Inventor: Keita Sugiura, Toyokawa (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 16/849,501

(22) Filed: Apr. 15, 2020

(65) Prior Publication Data

US 2020/0384769 A1 Dec. 10, 2020

(30) Foreign Application Priority Data

Jun. 5, 2019 (JP) ..... JP2019-105314

(51) Int. Cl.
*B41J 2/14* (2006.01)

(52) U.S. Cl.
CPC .. *B41J 2/14201* (2013.01); *B41J 2002/14419* (2013.01)

(58) Field of Classification Search
CPC ..... B41J 2/14201; B41J 2002/14419; B41J 2002/14459; B41J 2/14233; B41J 2202/12
See application file for complete search history.

(56) References Cited

U.S. PATENT DOCUMENTS 10,864,726 B2 * 12/2020 Miyazawa ..... B41J 2/14201
2014/0078224 A1 * 3/2014 Park ..... B41J 2/14233 347/71

FOREIGN PATENT DOCUMENTS

JP 2011-245795 A 12/2011
JP 2014-061695 A 4/2014

OTHER PUBLICATIONS

IP.com search (Year: 2022).*

* cited by examiner

*Primary Examiner* — Lisa Solomon
(74) *Attorney, Agent, or Firm* — Banner & Witcoff, Ltd.

(57) ABSTRACT

A liquid discharging head includes: individual channels aligned in a first direction; and a first common channel and a second common channel extending in the first direction. Each of the individual channels includes a nozzle, a first pressure chamber and second pressure chamber arranged side by side in the first direction, and a connecting channel connecting the nozzle, the first pressure chamber and the second pressure chamber to one another. A first actuator and a second actuator are provided on the first pressure chamber and the second pressure chamber, respectively. The first common channel communicates with the first and second pressure chambers; and the second common channel communicates with the connecting channel.

15 Claims, 12 Drawing Sheets

LIQUID DISCHARGING HEAD

CROSS REFERENCE TO RELATED APPLICATION

The present application claims priority from Japanese Patent Application No. 2019-105314, filed on Jun. 5, 2019, the disclosure of which is incorporated herein by reference in its entirety.

BACKGROUND

Field of the Invention

The present disclosure relates to a liquid discharging head provided with a plurality of common channels.

Description of the Related Art

There is known an ink-jet printer provided with individual channels each of which includes a nozzle, a first pressure chamber, a second pressure chamber, and a connecting channel connecting the nozzle and the first and second pressure chambers to one another. A first actuator and a second actuator are provided on the first pressure chamber and the second pressure chamber, respectively. The first pressure chamber communicates with a first common channel, and the second pressure chamber communicates with a second common channel. In a case that ink is circulated, the ink flows from the first common channel to the first pressure chamber, to the connecting channel, to the second pressure chamber, and to the second common channel.

SUMMARY

In the above-described ink-jet printer, the first pressure chamber communicates with the first common channel, and the second pressure chamber communicates with the second common channel. Therefore, in the case that the liquid is circulated, there arises any difference in the magnitude of negative pressure between the first and second pressure chambers; by being affected by the difference in the magnitude of the negative pressure, any difference might occur in the deformation amount between the first and second actuators. In such a case, even if a same waveform is applied to the first and second actuators, there is a difference in the initial deformation amount between the first and second actuators, and thus a same deformation amount is less likely to obtain for the first and second actuators, which in turn might cause any disturbance (unstableness) in the discharge of the liquid.

An object of the present disclosure is to provide a liquid discharging head capable of suppressing any difference in the deformation amount between the first and second actuators during the liquid circulation.

According to a first aspect of the present disclosure, there is provided a liquid discharging head including: individual channels aligned in a first direction; and a first common channel and a second common channel extending in the first direction, wherein each of the individual channels includes: a nozzle; a first pressure chamber and second pressure chamber arranged side by side in the first direction; and a connecting channel connecting the nozzle, the first pressure chamber and the second pressure chamber to one another, the first pressure chamber and the second pressure chamber being provided with a first actuator and a second actuator thereon, respectively, the first common channel communicates with the first and second pressure chambers, and the second common channel communicates with the connecting channel.

According to a second aspect of the present disclosure, there is provided a liquid discharging head including: individual channels aligned in a first direction; and a first common channel, a second common channel and a third common channel which extend in the first direction, wherein the first common channel, the second common channel and the third common channel are arranged side by side in a second direction which is a width direction of the first to third common channels, the second common channel being positioned between the first and third common channels in the second direction, each of the individual channels includes a nozzle, a first pressure chamber and second pressure chamber arranged side by side in the second direction, and a connecting channel connecting the nozzle, the first pressure chamber and the second pressure chamber to one another, the first pressure chamber and the second pressure chamber being provided with a first actuator and a second actuator thereon, respectively, the first common channel communicates with the first pressure chamber, the second common channel communicates with the connecting channel, and the third common channel communicates with the second pressure chamber.

DESCRIPTION OF THE EMBODIMENTS

First Embodiment

Figure 1:
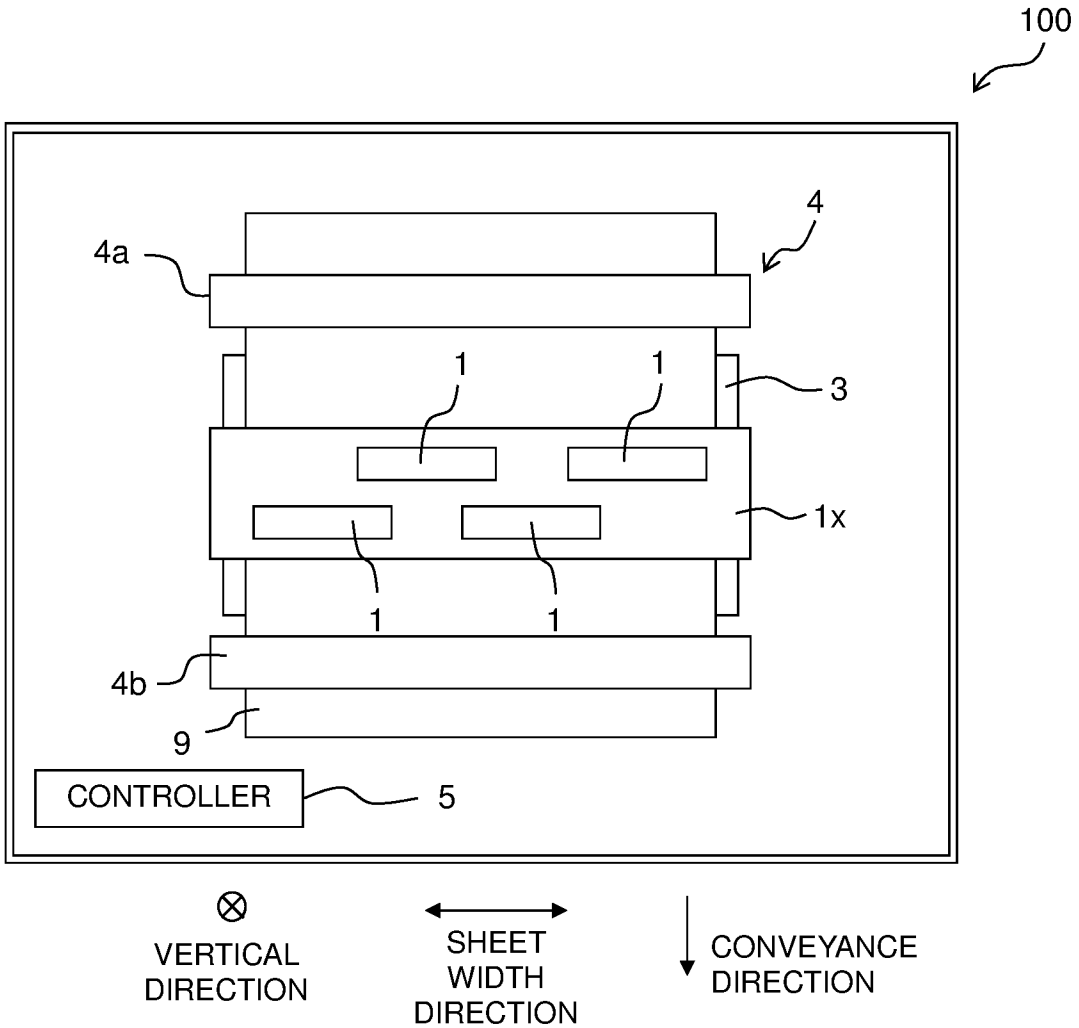
FIG. 1 is a plan view of a printer provided with a head according to a first embodiment of the present disclosure.

Firstly, the overall configuration of a printer 100 provided with a head 1 according to a first embodiment of the present disclosure will be explained, with reference to FIG. 1.

The printer 100 is provided with a head unit 1*x* including four heads 1, a platen 3, a conveying mechanism 4 and a controller 5.

A sheet 9 is placed on the upper surface of the platen 3.

The conveying mechanism 4 has two roller pairs 4*a* and 4*b* which are arranged with the platen 3 intervened therebetween in a conveyance direction. In a case that a conveying motor (of which illustration is omitted in the drawings) is driven by control of the controller 5, the roller pairs 4*a* and 4*b* rotate in a state that the sheet 9 is sandwiched or pinched therebetween, thereby conveying the sheet 9 in the conveying direction.

The head unit 1*x* is elongated in a sheet width direction (direction orthogonal to both of the conveyance direction and the vertical direction), and the head unit 1 is of a line system wherein an ink is discharged with respect to the sheet 9 from nozzles 21 (see FIGS. 2 to 4) in a state that the position of the head unit 1*x* is fixed. The four heads 1 are each elongated in the sheet width direction, and are arranged in a staggered manner in the sheet width direction.

The controller 5 has a ROM (Read Only Memory), a RAM (Random Access Memory) and an ASIC (Application Specific Integrated Circuit). The ASIC performs a recording processing, etc., in accordance with a program stored in the ROM. In the recording processing, the controller 5 controls a driver IC and the conveyance motor (both of which are omitted in the illustration of the drawings) of each of the heads 1, based on a recording instruction or recording command (including image data) inputted from an external apparatus or external device such as a PC, and performs recording of an image, etc., on the sheet 9.

Next, the configuration of each of the heads 1 will be explained with reference to FIGS. 2 to 4.

Figure 3:
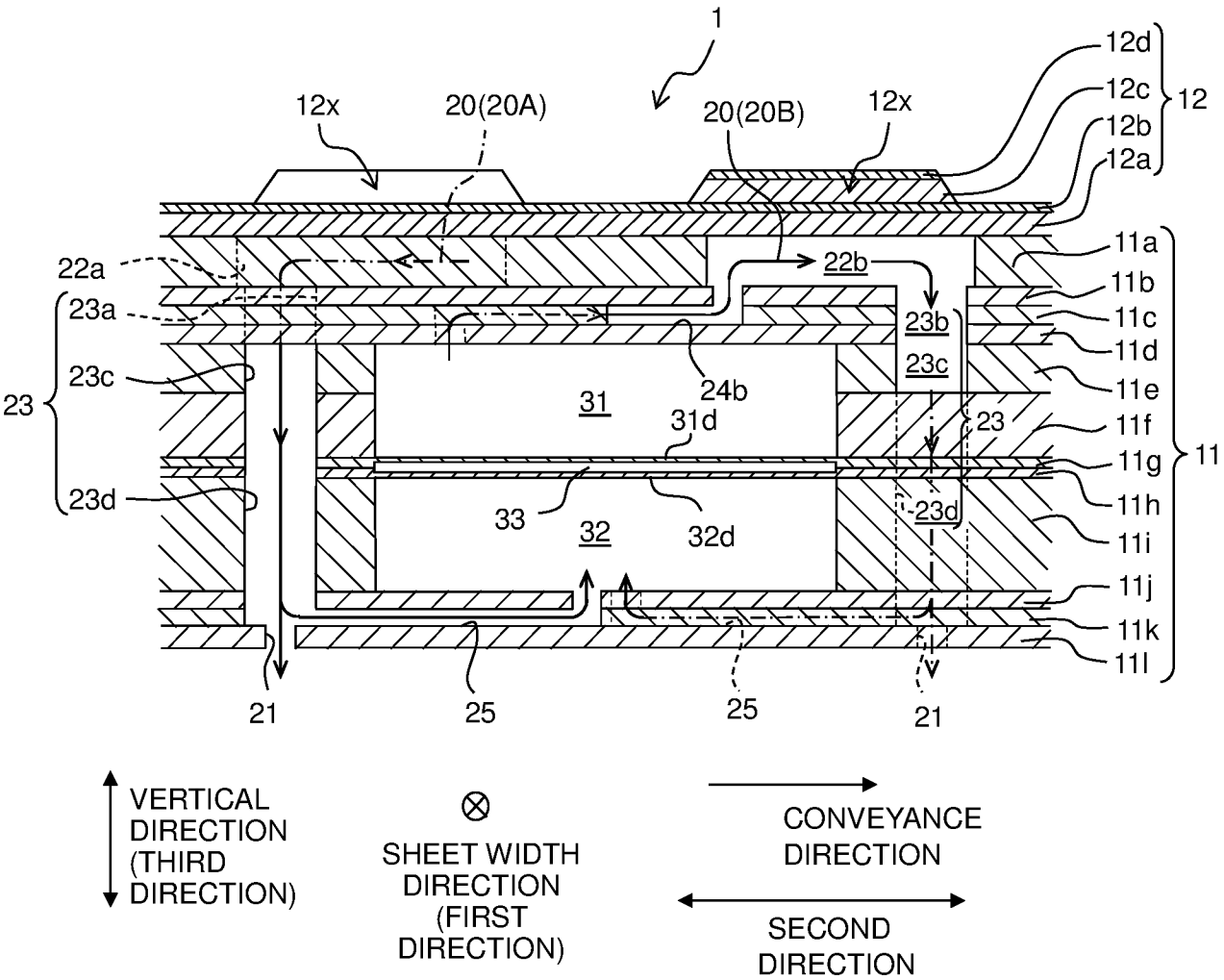
FIG. 3 is a cross-sectional view of the head, taken along a line in FIG. 2.

As depicted in FIG. 3, the head 1 has a channel substrate 11 and an actuator substrate 12.

The channel substrate 11 is constructed of 12 (twelve) plates 11A to 11*l* which are stacked in the vertical direction and adhered to one another. Each of the plates 11*a* to 11*l* has a through hole formed therein and constructing a channel. The channel includes a plurality of individual channels 20, a supply channel 31 and a return channel 32.

Figure 2:
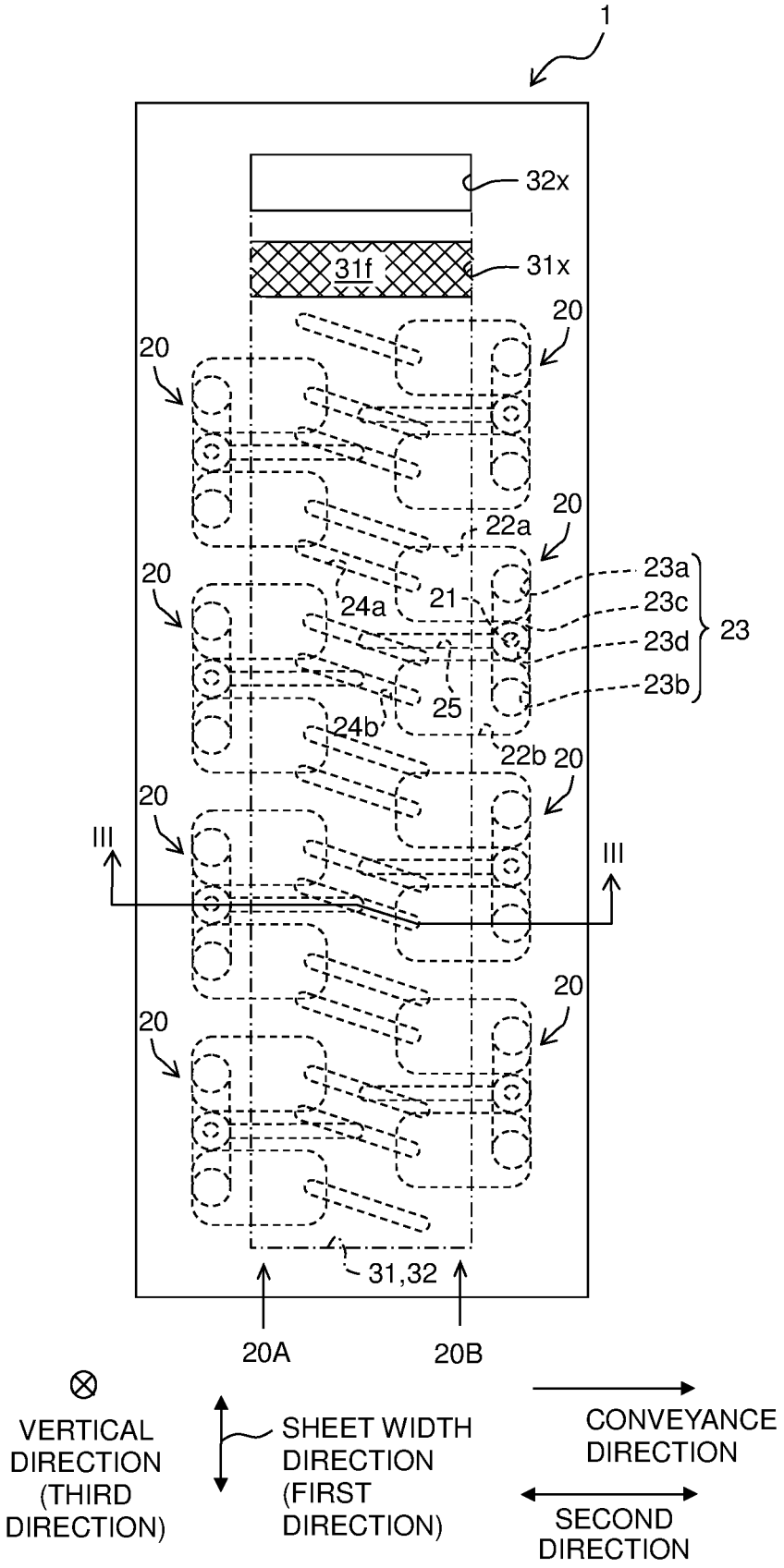
FIG. 2 is a plan view of the head.

As depicted in FIG. 2, the plurality of individual channels 20 are arranged in a staggered manner in the sheet width direction (first direction) and construct a first individual channel group 20A and a second individual channel group 20B. Each of the first and second individual channel groups 20A and 20B is constructed of individual channels 20 included in the plurality of individual channels 20 and arranged side by side in the first direction. The first individual channel group 20A and the second individual channel group 20B are arranged side by side in a direction parallel to the conveyance direction (second direction: a direction which is a width direction of the supply channel 31 and the return channel 32 and which is orthogonal to the first direction).

Each of the supply channel 31 and the return channel 32 extends in the first direction. The supply channel 31 corresponds to a "first common channel" of the present disclosure. The return channel 32 corresponds to a "second common channel" of the present disclosure. In the present embodiment, the supply channel 31 and the return channel 32 are arranged side by side in the vertical direction (third direction: a direction which is the height direction of each of the supply channel 31 and the return channel 32, and which is a direction orthogonal to both of the first and second directions), and overlap with each other in the vertical direction. The supply channel 31 and the return channel 32 have lengths (lengths in the first direction), widths (lengths in the second direction) and heights (lengths in the third direction) which are substantially same to each other, respectively.

The supply channel 31 and the return channel 32 are linked (connected) to each other at one ends thereof, respectively, in the first direction (lower ends thereof in FIG. 2).

The supply channel 31 and the return channel 32 communicate with a sub tank (omitted in the drawings) via a supply port 31*x* and a return port 32*x* provided on the other ends thereof, respectively, in the first direction (upper ends thereof in FIG. 2). The supply port 31*x* corresponds to an "opening of the first common channel" of the present disclosure, and the return port 32*x* corresponds to an "opening of the second common channel" of the present disclosure.

The supply port 31*x* and the return port 32*x* are formed on a same side to each other in the first direction with respect to the plurality of individual channels 20, and are arranged side by side in the first direction. In the first direction, the supply port 31*x* is formed between the plurality of individual channels 20 and the return port 32*x*. Namely, the spacing distance in the first direction between the return port 32*x* and the plurality of individual channels 20 is greater than the spacing distance in the first direction between the supply port 31*x* and the plurality of individual channels 20.

The supply port 31*x* and the return port 32*x* are open in the upper surface of the channel substrate 11. Although a filter 31*f* is provided on the supply port 31*x*, any filter is not provided on the return port 32*x*.

The sub tank communicates with a main tank storing the ink, and stores the ink supplied from the main tank thereto. In a case that a pump (omitted in the drawings) is driven by control performed by the controller 5, the ink inside the sub tank is thereby caused to flow into the supply channel 31 from the supply port 31*x*. The ink inflowed into the supply channel 31 is supplied to each of the plurality of individual channels 20 while moving inside the supply channel 31 from the other end in the first direction (upper end in FIG. 2) toward one end in the first direction (lower end in FIG. 2). The ink reaching the one end in the first direction (lower end in FIG. 2) of the supply channel 31 and the ink outflowed from each of the plurality of individual channels 20 flow into the return channel 32. The ink inflowed into the return channel 32 moves inside the return channel 32 from the one end in the first direction (lower end in FIG. 2) toward the other end in the first direction (upper end in FIG. 2), and is returned to the sub tank via the return port 32*x*.

As depicted in FIG. 3, the supply channel 31 is constructed of through holes formed in the plates 11*e* and 11*f*, respectively. The return channel 32 is constructed of a through hole formed in the plates 11*i*. A damper chamber 33 is provided at a location between the supply channel 31 and the return channel 31 in the third direction. The damper chamber 33 is constructed of a recessed part formed in the plate 11*g* and a recessed part formed in the plate 11*h*. The bottom part of the recessed part in the plate 11*g* functions as a damper film 31*d* of the supply channel 31. The bottom part of the recessed part in the plate 11*h* functions as a damper film 32*d* of the return channel 32.

As depicted in FIG. 2, each of the plurality of individual channels 20 includes one nozzle 21, two pressure chambers (a first pressure chamber 22*a* and a second pressure chamber 22*b*), one connecting channel 23, two inflow channels (a first inflow channel 24*a* and a second inflow channel 24*b*) and one outflow channel 25.

As depicted in FIG. 3, the nozzle 21 is constructed of a through hole formed in the plate 11*l*, and is open in the lower surface of the channel substrate 11. Each of the first pressure chamber 22*a* and the second pressure chamber 22*b* is formed of a through hole formed in the plate 11*a*, and is open in the upper surface of the channel substrate 11.

As depicted in FIG. 2, the first pressure chamber 22*a* and the second pressure chamber 22*b* have mutually same shapes and sizes, and are arranged side by side in the first direction. Each of the first and second pressure chambers 22*a* and 22*b* has a substantially rectangular shape which is elongated in the second direction in a plane parallel to the first and second directions (a plane orthogonal to the third direction). With respect to the first pressure chamber 22*a*, the connecting channel 23 is connected to one end in the second direction of the first pressure chamber 22*a*, and the first inflow channel 24*a* is connected to the other end in the second direction of the first pressure chamber 22*a*. With respect to the second pressure chamber 22*b*, the connecting channel 23 is connected to one end in the second direction of the second pressure chamber 22*b*, and the second inflow channel 24*b* is connected to the other end in the second direction of the second pressure chamber 22*b*.

The connecting channel 23 connects the nozzle 21 and the first and second pressure chambers 22*a* and 22*b* to one another. Specifically, as depicted in FIG. 4, the connecting channel 23 has a first connecting part 23*a* connected to the first pressure chamber 22*a*, a second connecting part 23*b* connected to the second pressure chamber 22*a*, a linking part 23*c* linking the first connecting part 23*a* and the second connecting part 23*b* to each other, and an extending part 23*d* extending downward from the linking part 23*c* and having the nozzle 32 arranged at a lower end of the extending part 23*d*.

Each of the first and second connecting parts 23*a* and 23*b* is a channel having a columnar shape and extending downward from one end in the second direction of one of the first and second pressure chambers 22*a* and 22*b*, and is constructed of through holes formed in the plates 11*b* to 11*d*, respectively, as depicted in FIG. 3. The configuration of the connecting channel 23, however, is not limited to or restricted by the above-described configuration; it is allowable that the connecting channel 23 is configured such that the linking part 23*c* is positioned at a location immediately below the first and second pressure chambers 22*a* and 22*b* (namely, any other channel such as a columnar-shaped channel is not interposed between the linking part 23*c* and each of the first and second pressure chambers 22*a* and 22*b*), as in a seventh embodiment (see FIG. 12) which will be described later on, and that each of the first and second connecting parts 23*a* and 23*b* is constructed of an interface between the linking part 23*c* and one of the first and second pressure chambers 22*a* and 22*b* (an opening formed in the lower surface of one of the first and second pressure chambers 22*a* and 22*b*).

As depicted in FIG. 3, the linking part 23*c* is constructed of a through hole formed in the plate 11*e*, and extends in the first direction along a plane orthogonal to the third direction.

As depicted in FIG. 3, the extending part 23*d* is constructed of through holes formed in the plates 11*f* to 11*k*, respectively, and extends in the third direction. In the third direction, the nozzle 21 is located at a location below (on a side opposite to the first and second pressure chambers 22*a* and 22*b*) with respect to the linking part 23*c*.

Figure 4:
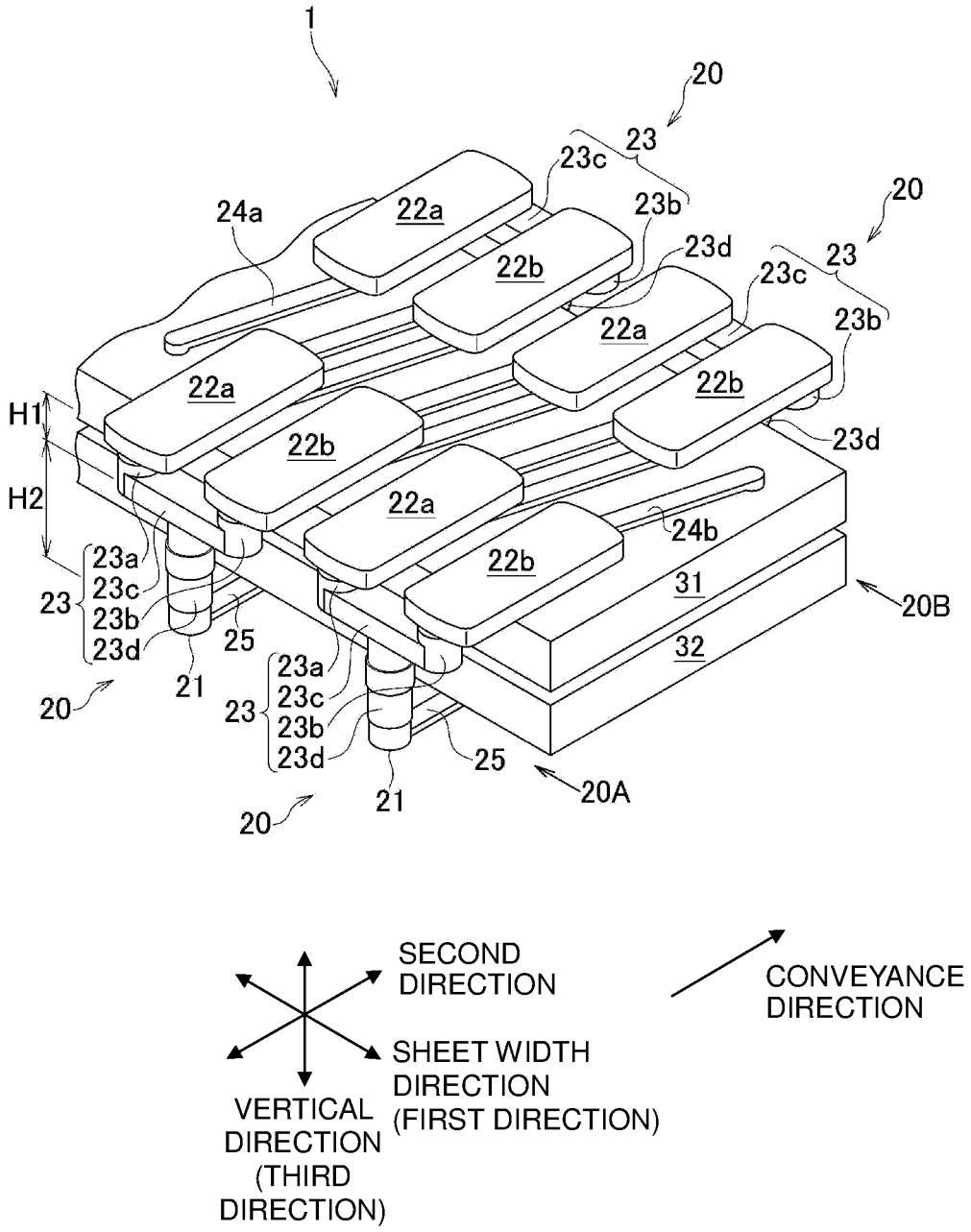
FIG. 4 is a perspective view depicting a part of a channel formed in the inside of the head.

In the present embodiment, as depicted in FIG. 4, a length H1 in the third direction from each of the first and second pressure chambers 22*a* and 22*b* to the linking part 23*c* is less than a length H2 in the third direction from the linking part 23*c* to the nozzle 21. Namely, the linking part 23*c* is positioned at an upper part of an area occupied by the connecting channel 23 (on a side closer to the first and second pressure chambers 22*a* and 22*b*).

As depicted in FIG. 2, each of the first and second pressure chambers 22*a* and 22*b* of one of the individual channels 20 belonging to the first individual channel group 20A has a part which overlaps with the supply channel 31 and the return channel 32 in the third direction, and a part which does not overlap with the supply channel 31 and the return channel 32 in the third direction and which is positioned on one side in the second direction with respect to the supply channel 31 and the return channel 32. Each of the first and second pressure chambers 22*a* and 22*b* of one of the individual channels 20 belonging to the second individual channel group 20A has a part which overlaps with the supply channel 31 and the return channel 32 in the third direction, and a part which does not overlap with the supply channel 31 and the return channel 32 in the third direction and which is positioned on the other side in the second direction with respect to the supply channel 31 and the return channel 32.

The connecting channel 23 and the nozzle 21 of each of the individual channels 20 belonging to the first individual channel group 20A are positioned on the one side in the second direction with respect to the supply channel 31 and the return channel 32. The connecting channel 23 and the nozzle 21 of each of the individual channels 20 belonging to the second individual channel group 20B are positioned on the other side in the second direction with respect to the supply channel 31 and the return channel 32.

The first inflow channel 24*a* has one end connected to the other end in the second direction (an end on a side opposite to an end to which the connecting channel 23 is connected) of the first pressure chamber 22*a*, and the other end connected to the supply channel 31. The second inflow channel 24*b* has one end connected to the other end in the second direction (an end on a side opposite to an end to which the connecting channel 23 is connected) of the second pressure chamber 22*b*, and the other end connected to the supply channel 31. The supply channel 31 communicates with the first pressure chamber 22*a* and the second pressure chamber 22*b* via the first inflow channel 24*a* and the second inflow channel 24*b*, respectively.

The first inflow channel 24*a* and the second inflow channel 24*b* are channels connecting the first pressure chamber 24 and the second pressure chamber 22*b* to the supply channel 31, respectively, and each correspond to a "joining channel" of the present disclosure. In the present embodiment, each of the first and second inflow channel 24*a* and 24*b* extends in an oblique direction crossing both of the first and second directions.

As depicted in FIG. 3, each of the first and second inflow channels 24*a* and 24*b* is constructed of through holes formed in the plates 11*b* to 11*d*, respectively.

As depicted in FIG. 3, the outflow channel 25 is constructed of through holes formed in the plates 11*j* and 11*k*, respectively, and has an end connected to a lower end of the extending part 23*d* and the other end connected to the return channel 32. The return channel 32 communicates with the connecting channel 23 via the outflow channel 25.

The outflow channel 25 is a channel communicating the connecting channel 23 with the return channel 32, and corresponds to a "communicating channel" of the present disclosure. In the present embodiment, the outflow channel 25 extends in the second direction, as depicted in FIG. 2.

Each of the first and second inflow channels 24*a* and 24*b* and the outflow channel 25 has a width (length in the first direction) which is smaller than a width (length in the first direction) of one of the first and second pressure chambers 22*a* and 22*b*, and functions as a throttle.

The ink supplied from the supply channel 31 to each of the plurality of individual channels 20 passes through the first inflow channel 24*a* and the second inflow channel 24*b* and inflows into the first pressure chamber 22*a* and the second pressure chamber 22*b*, respectively, moves substantially horizontally in the inside of the each of the first and second pressure chambers 22*a* and 22*b*, and then inflows into the connecting channel 23. The ink inflowed into the connecting channel 23 passes through the first connecting part 23*a* and the second connecting part 23*b*, arrives at the linking part 23*c*, passes through the extending part 23*d* and moves downward; a part or portion of the ink is discharged from the nozzle 21, and a remaining part of the ink passes through the outflow channel 25 and inflows into the return channel 32.

In such a manner, the ink is circulated between the sub tank and the channel substrate 11, thereby realizing discharge of air and prevention of increase in the viscosity of the ink in the supply channel 31 and the return channel 32, and further in each of the individual channels 20, which are formed in the channel substrate 11. Further, in such a case that the ink contains a sedimentary component (a component which might sediment or settle; a pigment, etc.), such a sediment component is agitated, which in turn prevents any sedimentation thereof from occurring.

As depicted in FIG. 3, the actuator substrate 12 includes, in an order from the lower side thereof, a vibration plate 12*a*, a common electrode 12*b*, a plurality of piezoelectric bodies 12*c* and a plurality of individual electrodes 12*d*.

The vibration plate 12*a* and the common electrode 12*b* are arranged on the upper surface of the channel substrate 11 (upper surface of the plate 11*a*), and covers all the first and second pressure chambers 22*a* and 22*b* formed in the plate 11*a*. On the other hand, each of the plurality of piezoelectric bodies 12*c* and each of the plurality of individual electrodes 12*d* are provided with respect to one of the first and second pressure chambers 22*a* and 22*b*, and are overlapped with one of the first and second pressure chambers 22*a* and 22*b* in the third direction.

The common electrode 12*b* and the plurality of individual electrodes 12*d* are electrically connected to a driver IC (omitted in the drawings). The driver IC maintains the potential of the common electrode 12*b* at the ground potential, whereas changes the potential of each of the plurality of individual electrodes 12*d*. Specifically, the driver IC generates a driving signal based on a control signal from the controller 5, and applies the driving signal to each of the plurality of individual electrodes 12*d*. By doing so, the potential of each of the plurality of individual electrodes 12*d* is changed between a5 predetermined driving potential and the ground potential. In this situation, parts or portions in the vibration plate 12*a* and one of the plurality of piezoelectric bodies 12*c*, respectively, which are sandwiched between each of the plurality of individual electrodes 12*d* and one of the first and second pressure chambers 22*a* and 22*b* corresponding thereto are deformed so as to project toward one of the first and second pressure chambers 22*a* and 22*b*. With this, the volume of one of the first and second pressure chambers 22*a* and 22*b* is changed, which in turn applies the pressure to the ink inside one of the first and second pressure chambers 22*a* and 22*b*, thereby causing the ink to be discharged from the nozzle 21. The actuator substrate 12 has a plurality of pieces of the actuator 12*x* corresponding to the first and second pressure chambers 22*a* and 22*b*, respectively.

As described above, according to the present embodiment, the supply channel 31 communicates with the first pressure chamber 22*a* and the second pressure chamber 22*b*, and the return channel 32 communicates with the connecting channel 23 (see FIGS. 2 to 4). Namely, a same common channel (supply channel 31) communicates with respect to the first and second pressure chambers 22*a* and 22*b*. In this case, during the ink circulation, any difference in the magnitude of negative pressure is hardly caused between the first and second pressure chambers 22*a* and 22*b*, which in turn makes it possible to suppress the occurrence of any difference in the deformation amount, otherwise caused by being affected by the difference in the magnitude of the negative pressure, between actuators (an actuator 12*x* corresponding to the first pressure chamber 22*a* and an actuator 12*x* corresponding to the second pressure chamber 22*b*). Accordingly, in a case that a same waveform is applied to the above-described two actuators 12*x*, a same deformation amount is easily obtainable and any disturbance is less likely to occur in the discharge.

Further, in the conventional ink-jet printer as described above, the air entering from the nozzle into the individual channel needs to pass through a relatively long route reaching up to the second common channel via the connecting channel and the second pressure chamber. In contrast, in the present embodiment, the air entering from the nozzle 21 into the individual channel 20 does not need to pass through the second pressure chamber 22*b* until reaching up to the return channel 32, and thus the route via which the air passes is short, which results in the increase in the air discharging efficiency (air discharging performance). Furthermore, the present embodiment is capable of lowering the number of the common channel (the supply channel and the return channel), as compared with a second embodiment (FIG. 5) and a third embodiment (FIG. 7) which will be described later on. Accordingly, it is possible to realize a simple configuration and/or a miniaturized configuration of the liquid discharging head.

The length H1 in the third direction from each of the first and second pressure chambers 22*a* and 22*b* to the linking part 23*c* is less than the length H2 in the third direction from the linking part 23*c* to the nozzle 21 (see FIG. 4). In this case, since the length in the third direction from each of the first and second pressure chambers 22*a* and 22*b* up to the linking part 23*c* is short, the compliance of the connecting channel 23 as a whole is made to be small. With this, the pressure during the ink discharge is efficiently propagated to the nozzle 21, thereby enhancing the discharge efficiency.

The filter 31*f* is provided on the supply channel 31, and any filter is not provided on the return channel 32 (see FIG. 2). In a case that a filter is provided on the return channel 32, the filter hinders the exhaust (discharge) of the air via the return channel 32. In contrast, in the present embodiment, the above-described problem can be suppressed since any filter is not provided on the return channel 32. (Note that during a purge performed in a state that a valve on the return side is closed (an operation of driving a pump to thereby forcibly exhaust or discharge the ink from the nozzles 21), the ink is supplied from the supply channel 31 to each of the individual channels 20, and the ink is not supplied from the return channel 32 to each of the individual channels 20. Accordingly, although the filter is necessary for the supply channel 31 in order to prevent any foreign matter from entering into each of the individual channels 20, any filer is not necessary for the return channel 32.)

Second Embodiment

Next, a head 201 according to a second embodiment of the present disclosure will be explained, with reference to FIGS. 5 and 6.

In the first embodiment (FIGS. 2 and 3), the supply channel 31 and the return channel 32 are arranged side by side in the third direction, and are linked (connected) to each other at the one ends thereof, respectively, in the first direction. In the second embodiment (FIGS. 5 and 6), however, a supply channel 231 and a return channel 232 are arranged side by side in the second direction, and are not linked (connected) to each other at one ends thereof, respectively, in the first direction. Further, although the head 1 of the first embodiment has one supply channel 31, the head 201 of the second embodiment has two supply channels 231. In the second embodiment, one return channel 232 is arranged between the two supply channels 231 in the second direction, and two supply ports 231*x* and one return port 232*x* are arranged side by side in the second direction.

In the first embodiment (FIG. 3), the damper chamber 33 is provided between the supply channel 31 and the return channel 32 in the third direction. In the second embodiment (FIG. 6), however, damper chambers 233 are provided with respect to the two supply channels 231, respectively, each at a location therebelow (one side in the third direction); and a damper chamber 233 is provided with respect to the return channel 232 at a location thereabove (the other side in the third direction).

Figure 6:
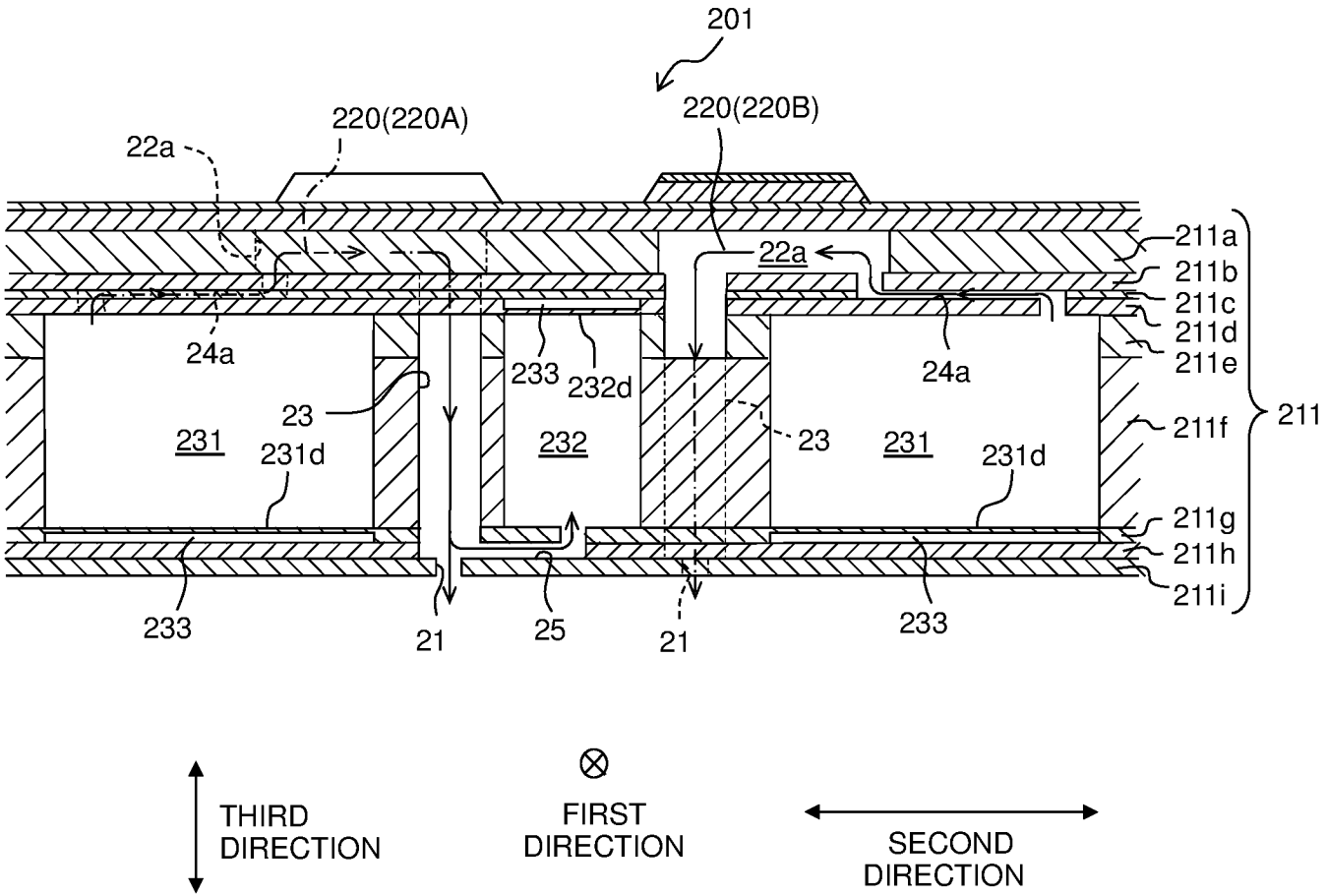
FIG. 6 is a cross-sectional view of the head, taken along a line VI-VI in FIG. 5.

A channel substrate 211 of the second embodiment is constructed of 9 (nine) plates 211*a* to 211*i* which are stacked on top of one another in the third direction and adhered to one another, as depicted in FIG. 6. Each of the plates 211*a* to 211*i* has through holes formed therein and constructing a plurality of individual channels 220, the two supply channels 231 and the return channel 232.

Each of the two supply channels 231 and the return channel 232 is constructed of through holes formed in the plates 211*e* and 211*f*, respectively. Each of the damper chambers 233 corresponding to the two supply channels 231, respectively, is constructed of a recessed part formed in the plate 211*g*. The bottom part of the recessed part in the plate 211*g* functions as a damper film 231*d* of each of the two supply channels 231. The damper chamber 233 corresponding to the return channel 232 is constructed of a recessed part formed in the plate 211*d*. The bottom part of the recessed part in the plate 211*d* functions as a damper film 232*d* of the return channels 232.

Figure 5:
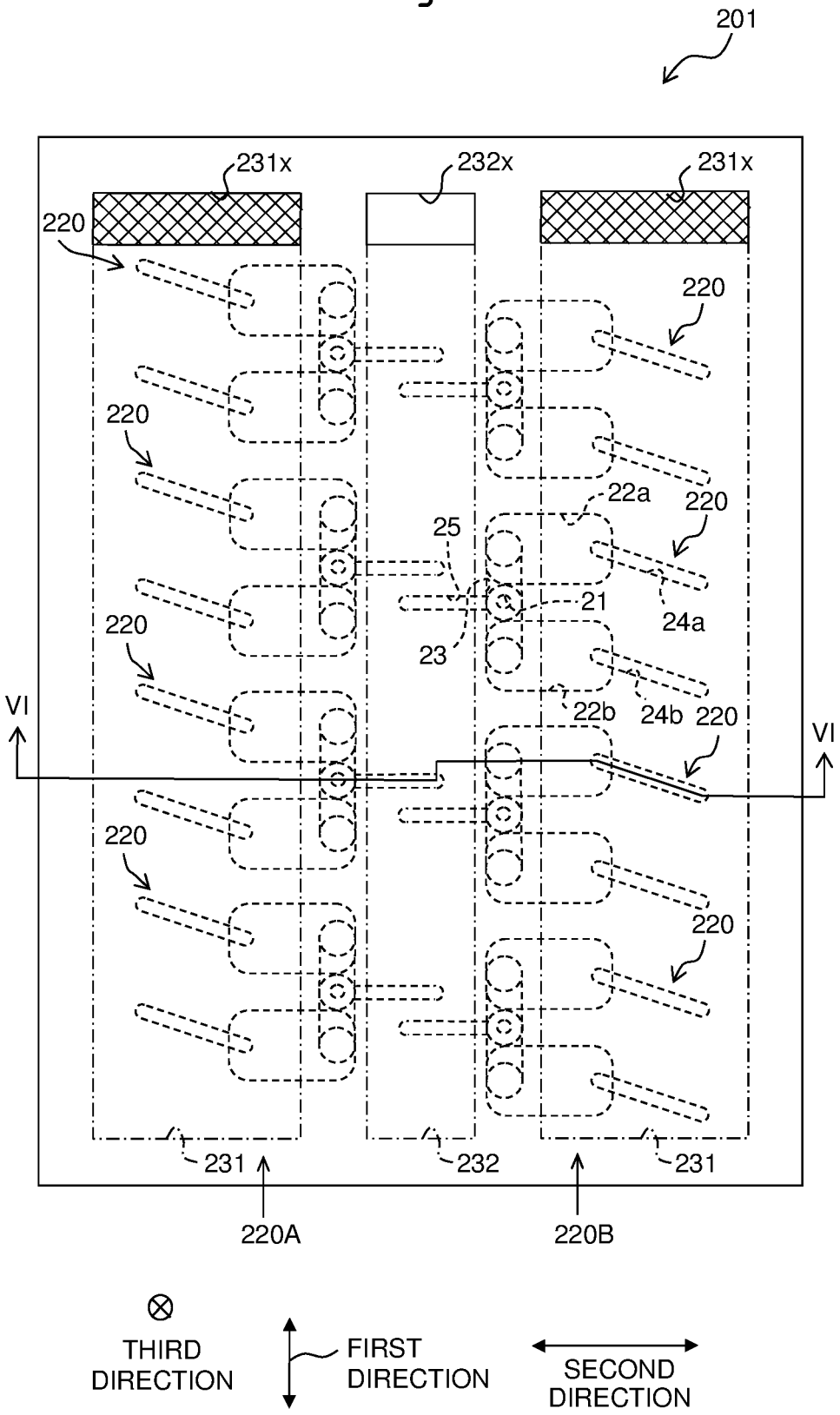
FIG. 5 is a plan view of a head according to a second embodiment of the present disclosure.

As depicted in FIG. 5, the plurality of individual channels 220 are arranged in a staggered manner in the first direction and construct a first individual channel group 220A and a second individual channel group 220B. Each of the first and second individual channel groups 220A and 220B is constructed of individual channels 220 included in the plurality of individual channels 220 and arranged side by side in the first direction. The first individual channel group 220A and the second individual channel group 220B are arranged side by side in the second direction.

Each of the respective individual channels 220 belonging to the first individual channel group 220A communicates with one of the two supply channels 231 (a supply channel 231 on the left side in FIGS. 5 and 6) via a first inflow channel 24*a* or a second inflow channel 24*b*, and communicates with the return channel 232 via an outflow channel 25. Each of the respective individual channels 220 belonging to the second individual channel group 220B communicates with the other of the two supply channels 231 (a supply channel 231 on the right side in FIGS. 5 and 6) via the first inflow channel 24*a* or the second inflow channel 24*b*, and communicates with the return channel 232 via the outflow channel 25.

Each of the pressure chambers 22*a* and 22*b* belonging to the first individual channel group 220A has a part which overlaps, in the third direction, with one of the two supply channels 231 (the supply channel 231 on the left side in FIGS. 5 and 6), and a part which does not overlap, in the third direction, with the one of the two supply channels 231 and which is positioned, in the second direction, between the one of the two supply channels 231 and the return channel 232. Each of the pressure chambers 22*a* and 22*b* belonging to the second individual channel group 220B has a part which overlaps, in the third direction, with the other of the two supply channels 231 (the supply channel 231 on the right side in FIGS. 5 and 6), and a part which does not overlap, in the third direction, with the other of the two supply channels 231 and which is positioned, in the second direction, between the other of the two supply channels 231 and the return channel 232.

The connecting channel 23 and the nozzle 21 of each of the individual channels 20 belonging to the first individual channel group 220A are positioned, in the second direction, between the one of the two supply channels 231 and the return channel 232. The connecting channel 23 and the nozzle 21 of each of the individual channels 20 belonging to the second individual channel group 220B are positioned, in the second direction, between the other of the two supply channels 231 and the return channel 232.

As described above, according to the second embodiment, although the second embodiment has the configuration of the channel different from that of the first embodiment, the second embodiment satisfies the requirement (the same common channel (supply channel 231) communicates with the first pressure chamber 22*a* and the second pressure chamber 22*b* of each of the individual channels 220) similar to that in the first embodiment. With this, the effects similar to those in the first embodiment can be achieved.

Further, in the second embodiment, the damper film 232*d* (second damper) of the return channel 232 is constructed of the plate 211*d* constructing each of the first and second inflow channels 24*a* and 24*b* (see FIG. 6). In this case, it is possible to reduce the number of the parts or components and to realize a simplified configuration, as well as to suppress the thickness in the third direction of the head 201. (It is also possible to achieve effects which are similar to the above-described effects by constructing the damper film 231*d* of each of the two supply channels 231 with the plate 211*g* constructing the return channel 25.)

Third Embodiment

Next, a head 301 according to a third embodiment of the present disclosure will be explained, with reference to FIGS. 7 and 8.

In the first embodiment (FIGS. 2 and 3), the supply channel 31 and the return channel 32 are arranged side by side in the third direction, and are linked (connected) to each other at the one ends thereof, respectively, in the first direction. In the third embodiment (FIGS. 7 and 8), however, a supply channel 331 and a return channel 332 are arranged side by side in the second direction, and are not linked (connected) to each other at one ends thereof, respectively, in the first direction, in a similar manner to the second embodiment. Further, although the head 1 of the first embodiment has one supply channel 31, the head 301 of the third embodiment has two supply channels 331, similarly to the second embodiment. In the third embodiment, one return channel 332 is arranged between the two supply channels 331 in the second direction, and two supply ports 331*x* and one return port 332*x* are arranged side by side in the second direction, in a similar manner to the second embodiment.

One of the two supply channels 331 (a supply channel 331 on the left side in FIGS. 7 and 8) corresponds to a "first common channel" of the present disclosure, the return channel 332 corresponds to a "second common channel" of the present disclosure, and the other of the two supply channels 331 (a supply channel 331 on the right side in FIGS. 7 and 8) corresponds to a "third common channel" of the present disclosure. Pressures which are mutually same are applied to the two supply channels 331, respectively.

In the first embodiment (FIG. 3), the damper chamber 33 is provided between the supply channel 31 and the return channel 32 in the third direction. In the third embodiment (FIG. 8), however, damper chambers 333 are provided with respect to the two supply channels 331, respectively, each at a location therebelow (one side in the third direction); and a damper chamber 333 is provided with respect to the return channel 332 at a location thereabove (the other side in the third direction), similarly to the second embodiment.

Figure 8:
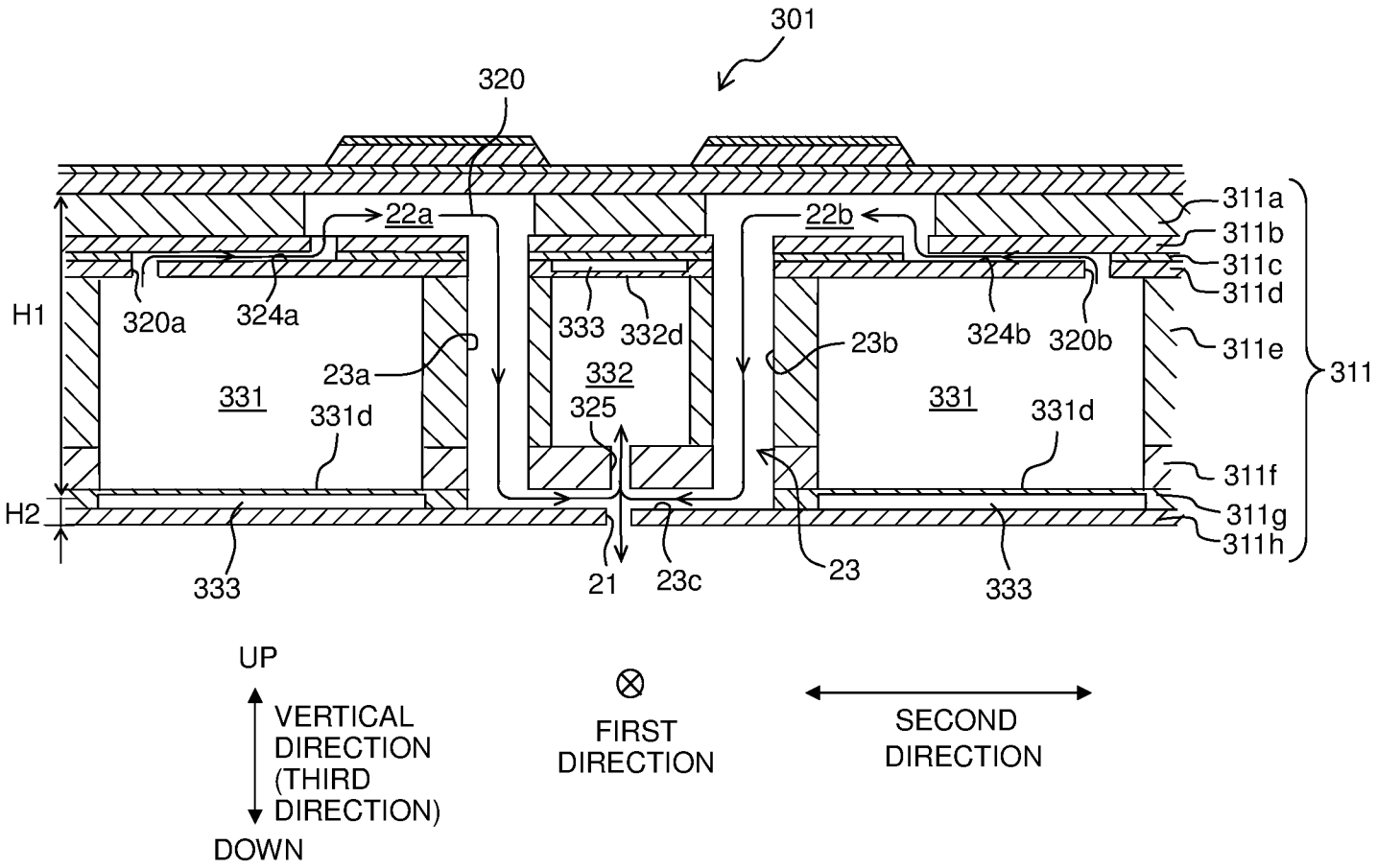
FIG. 8 is a cross-sectional view of the head, taken along a line VIII-VIII in FIG. 7.

A channel substrate 311 of the third embodiment is constructed of 8 (eight) plates 311*a* to 311*h* which are stacked on top of one another in the third direction and adhered to one another, as depicted in FIG. 8. Each of the plates 311*a* to 311*h* has a through hole formed therein and constructing a plurality of individual channels 320, the two supply channels 331 and the return channel 332.

Each of the two supply channels 331 is constructed of through holes formed in the plates 311*e* and 311*f*, respectively. The return channel 332 is formed of a through hole formed in the plate 311*e*. Each of the damper chambers 333 corresponding to the two supply channels 331, respectively, is constructed of a recessed part formed in the plate 311*g*. The bottom part of the recessed part in the plate 311*g* functions as a damper film 331*d* of each of the two supply channels 331. The damper chamber 333 corresponding to the return channel 332 is constructed of a recessed part formed in the plate 311*d*. The bottom part of the recessed part in the plate 311*d* functions as a damper film 332*d* of the return channels 332.

Figure 7:
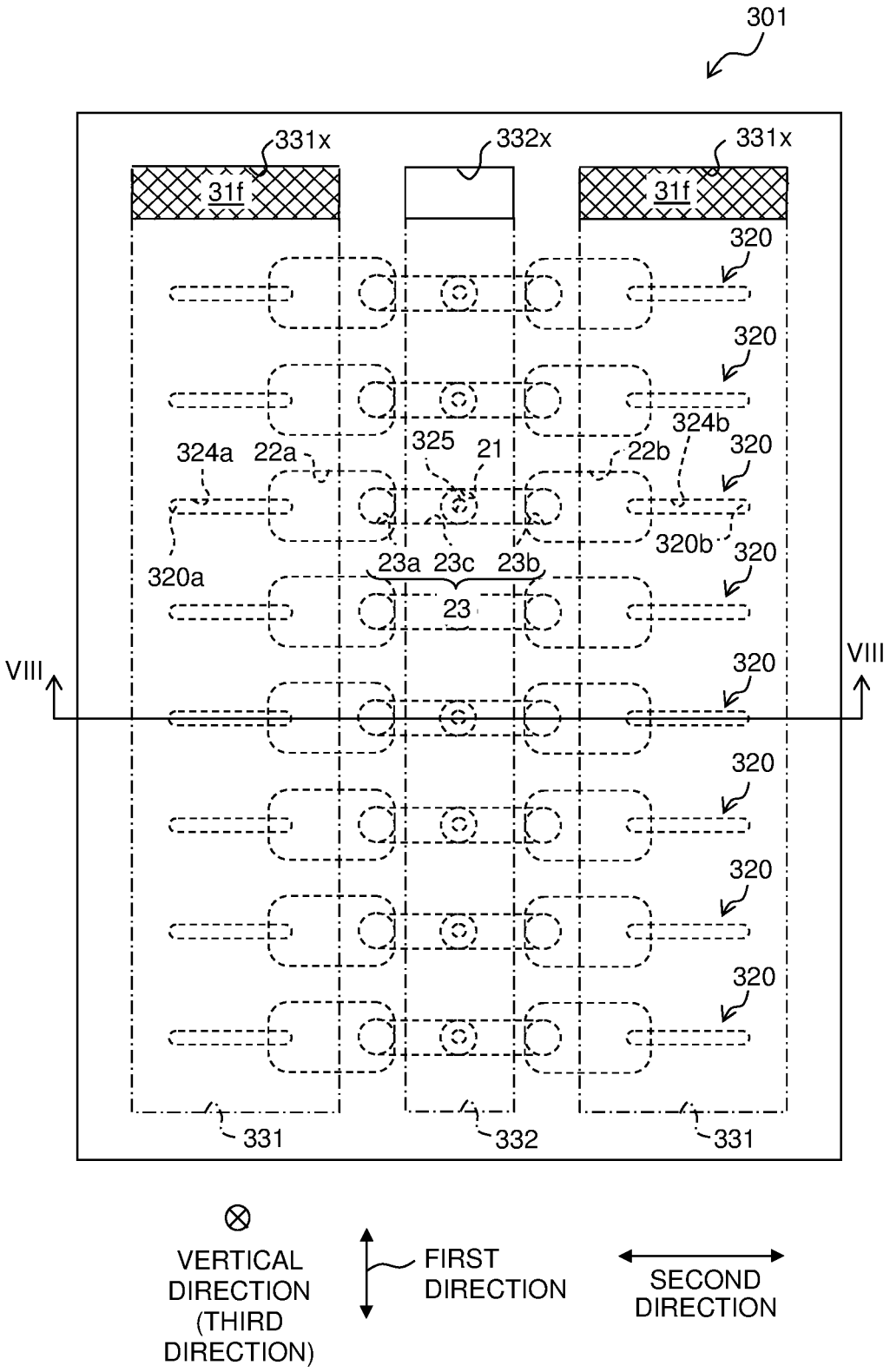
FIG. 7 is a plan view of a head according to a third embodiment of the present disclosure.

As depicted in FIG. 7, the plurality of individual channels 320 are arranged in a row (array) in the first direction. Each of the individual channels 320 includes one nozzle 21, two pressure chambers (a first pressure chamber 22*a* and a second pressure chamber 22*b*), one connecting channel 23, two inflow channels (a first inflow channel 324*a* and a second inflow channel 324*b*) and one outflow channel 325.

In the first embodiment (FIG. 2), the first pressure chamber 22*a* and the second pressure chamber 22*b* of each of the individual channels 20 are arranged side by side in the first direction. In the third embodiment (FIG. 7), however, the first pressure chamber 22*a* and the second pressure chamber 22*b* of each of the individual channels 320 are arranged side by side in the second direction. With respect to the first pressure chamber 22*a*, the connecting channel 23 is connected to one end in the second direction of the first pressure chamber 22*a*, and the first inflow channel 324*a* is connected to the other end in the second direction of the first pressure chamber 22*a*. With respect to the second pressure chamber 22*b*, the connecting channel 23 is connected to the other end in the second direction of the second pressure chamber 22*b*, and the second inflow channel 324*b* is connected to one end in the second direction of the second pressure chamber 22*b*.

In the third embodiment, each of the first pressure chamber 22*a* has a part which overlaps, in the third direction, with one of the two supply channels 331 (the supply channel 331 on the left side in FIGS. 7 and 8), and a part which does not overlap, in the third direction, with the one of the two supply channels 331 and which is positioned, in the second direction, between the one of the two supply channels 331 and the return channel 332. The second pressure chamber 22*b* has a part which overlaps, in the third direction, with the other of the two supply channels 331 (the supply channel 331 on the right side in FIGS. 7 and 8), and a part which does not overlap, in the third direction, with the other of the two supply channels 331 and which is positioned, in the second direction, between the other of the two supply channels 331 and the return channel 332.

The first pressure chamber 22*a* communicates with one of the two supply channels 331 (the supply channel 331 on the left side in FIGS. 7 and 8) via the first inflow channel 324*a*. The second pressure chamber 22*b* communicates with the other of the two supply channels 331 (the supply channel 331 on the right side in FIGS. 7 and 8) via the second inflow channel 324*b*. Each of the first and second inflow channels 324*a* and 324*b* extends in the second direction.

In each of the individual channels 320, the first inflow channel 324*a*, the second inflow channel 324*b*, the connecting channel 23, the first pressure chamber 22*a* and the second pressure chamber 22*b* are arranged side by side so as to form a row (array) in the second direction, as depicted in FIG. 7. In each of the individual channels 320, an end 320*a* communicating with the one of the two supply channels 331 and the other end 320*b* communicating with the other of the two supply channels 331 are arranged at positions, respectively, which are same to each other in the first direction.

The connecting channel 23 is positioned between the two supply channels 331 in the second direction. The nozzle 21 is positioned between the two supply channels 331 in the second direction, and overlaps with the return channel 332 in the third direction.

First and second connecting parts 23*a* and 23*b* of the connecting channel 23 are longer in the third direction than the first and second connecting parts 23*a* and 23*b* of the first embodiment (FIG. 4), as depicted in FIG. 8, and are longer than the heights of the two supply channels 331 and the return channel 332.

In the first embodiment (FIG. 2), the connecting part 23*c* extends in the first direction. In the third embodiment (FIG. 7), however, the connecting part 23*c* extends in the second direction.

In the first embodiment (FIG. 4), the connecting channel 23 has the extending part 23*d*. In the third embodiment, however, the connecting part 23*c* does not have the extending part 23*d*, and the nozzle 21 is positioned at a location immediately below the linking part 23*c* (namely, any other channel is not interposed between the linking part 23*c* and the nozzle 21).

In the third embodiment, as depicted in FIG. 8, a length H1 in the third direction from each of the first and second pressure chambers 22*a* and 22*b* to the linking part 23*c* is not less than a length H2 in the third direction from the linking part 23*c* to the nozzle 21. Namely, the linking part 23*c* is positioned at a lower part of an area occupied by the connecting channel 23 (on a side closer to the nozzle 21). Since the length in the third direction from each of the first and second pressure chambers 22*a* and 22*b* to the linking part 23*c* is long, the resistance in the connecting part 23 as a whole becomes small. With this, a circulation amount of the ink can be increased.

As depicted in FIG. 8, the outflow channel 325 is constructed of a through hole formed in the plate 311*f*, extends in the third direction, and has a lower end connected to the linking part 23*c* and an upper part connected to the return channel 322. Namely, the return channel 322 communicates with the connecting channel 23 via the outflow channel 325. The outflow channel 325 extends upward from the linking part 23*c* and reaches the return channel 332. The nozzle 21 overlaps, in the vertical direction (third direction), with the outflow channel 325.

The ink supplied from each of the two supply channels 331 to each one of the plurality of individual channels 320 passes through the first inflow channel 324*a* or the second inflow channel 324*b*, inflows into the first pressure chamber 22*a* or the second pressure chamber 22*b*, moves substantially horizontally in the inside of the first pressure chamber 22*a* or the second pressure chamber 22*b*, and then inflows in to the connecting channel 23. The ink inflowed into the connecting channel 23 passes through the first connecting part 23*a* and the second connecting part 23*b*, arrives at one end and the other end in the second direction of the linking part 23*c*, respectively. Then, the ink moves from the both ends (one end and the other end) toward the center in the second direction of the linking part 23*c*, and a part or portion of the ink is discharged from the nozzle 21, and a remaining part of the ink passes through the outflow channel 325 and inflows into the return channel 332.

As described above, according to the third embodiment, the first pressure chamber 22*a* communicates with one of the two supply channels 331, the second pressure chamber 22*b* communicates with the other of the two supply channels 331, and the connecting channel 23 communicates with the return channel 332 (see FIGS. 7 and 8). In this case, it is possible to realize a configuration in which any difference in the magnitude of negative pressure is hardly caused between the first and second pressure chambers 22*a* and 22*b* during the ink circulation, which in turn makes it possible to suppress the occurrence of any difference in the deformation amount, which would be otherwise caused by being affected by the difference in the magnitude of the negative pressure between the respective actuators (an actuator corresponding to the first pressure chamber 22*a* and an actuator corresponding to the second pressure chamber 22*b*).

Further, in the conventional ink-jet printer as described above, the air entering from the nozzle into the individual channel needs to pass through a relatively long route until reaching up to the second common channel via the connecting channel and the second pressure chamber. In contrast, in the third embodiment, the air entering from the nozzle 21 into the individual channel 320 does not need to pass through the second pressure chamber 22*b* until reaching up to the return channel 332, and thus the route via which the air passes is short, which results in the increase in the air discharging efficiency (air discharging performance).

In the individual channel 320, the one end 320*a* communicating with the one of the two supply channels 331 and the other end 320*b* communicating with the other of the two supply channels 331 are arranged at the positions which are same to each other in the first direction (see FIG. 7). In this case, it is possible to make the pressure to be same in the first and second pressure chambers 22*a* and 22*b*, and to prevent the meniscus of the nozzle 21 from being destroyed during the ink circulation.

The outflow channel 325 extends upward from the linking part 23*c* and reaches the return channel 332 (see FIG. 8). In this case, the air reaching the outflow channel 325 is discharged smoothly to the return channel 325 due to the action of the buoyancy. Accordingly, any non-discharge can be resolved quickly.

The nozzle 21 is positioned at the location immediately below the linking part 23*c* (see FIG. 8). In this case, the air entering from the nozzle 21 reaches the linking part 23*c* quickly, passes through the outflow channel 325 and is discharged to the return channel 332. Accordingly, any non-discharge can be resolved more quickly.

The nozzle 21 overlaps, in the vertical direction (third direction), with the outflow channel 325 (see FIG. 7). In this case, the air entering from the nozzle 21 reaches the outflow channel 325 quickly via the linking part 23*c*, and is discharged to the return channel 332. Accordingly, any non-discharge can be resolved more quickly.

A filter 31*f* is provided on the supply channel 331, and any filter is not provided on the return channel 332 (see FIG. 7). In a case that a filter is provided on the return channel 332, the filter hinders the exhaust (discharge) of the air via the return channel 332. In contrast, in the third embodiment, the above-described problem can be suppressed since any filter is not provided on the return channel 332. (Note that in a case that a purge (an operation of driving a pump to thereby forcibly exhaust or discharge the ink from the nozzles 21) is performed, the ink is supplied from each of the two supply channels 331 to each one of the individual channels 320, and the ink is not supplied from the return channel 332 to each one of the individual channels 320. Although the filter is necessary for the supply channel 331 in order to prevent any foreign matter from entering into each of the individual channels 320, any filer is not necessary for the return channel 332.)

The damper film 331*d* (first damper) is provided on each of the two supply channels 331 (see FIG. 8). In this case, the pressures in the respective damper films 331*d* during the ink circulation can be substantially same. Consequently, by making the compliance to be same in the respective damper films 331*d*, it is possible to realize a stable discharge.

The damper film 332*d* (second damper) of the return channel 332 is constructed of the plate 311*d* constructing the inflow channels 324*a* and 324*b* (see FIG. 8). In this case, it is possible to reduce the number of the parts or components and to realize a simplified configuration of the liquid discharging head (head 301), as well as to suppress the thickness in the third direction of the head 301. (It is also possible to achieve effects which are similar to the above-described effects by constructing the damper film 331*d* of each of the two supply channels 331 with the plate 311*g* constructing the return channel 325.)

Fourth Embodiment

Figure 9:
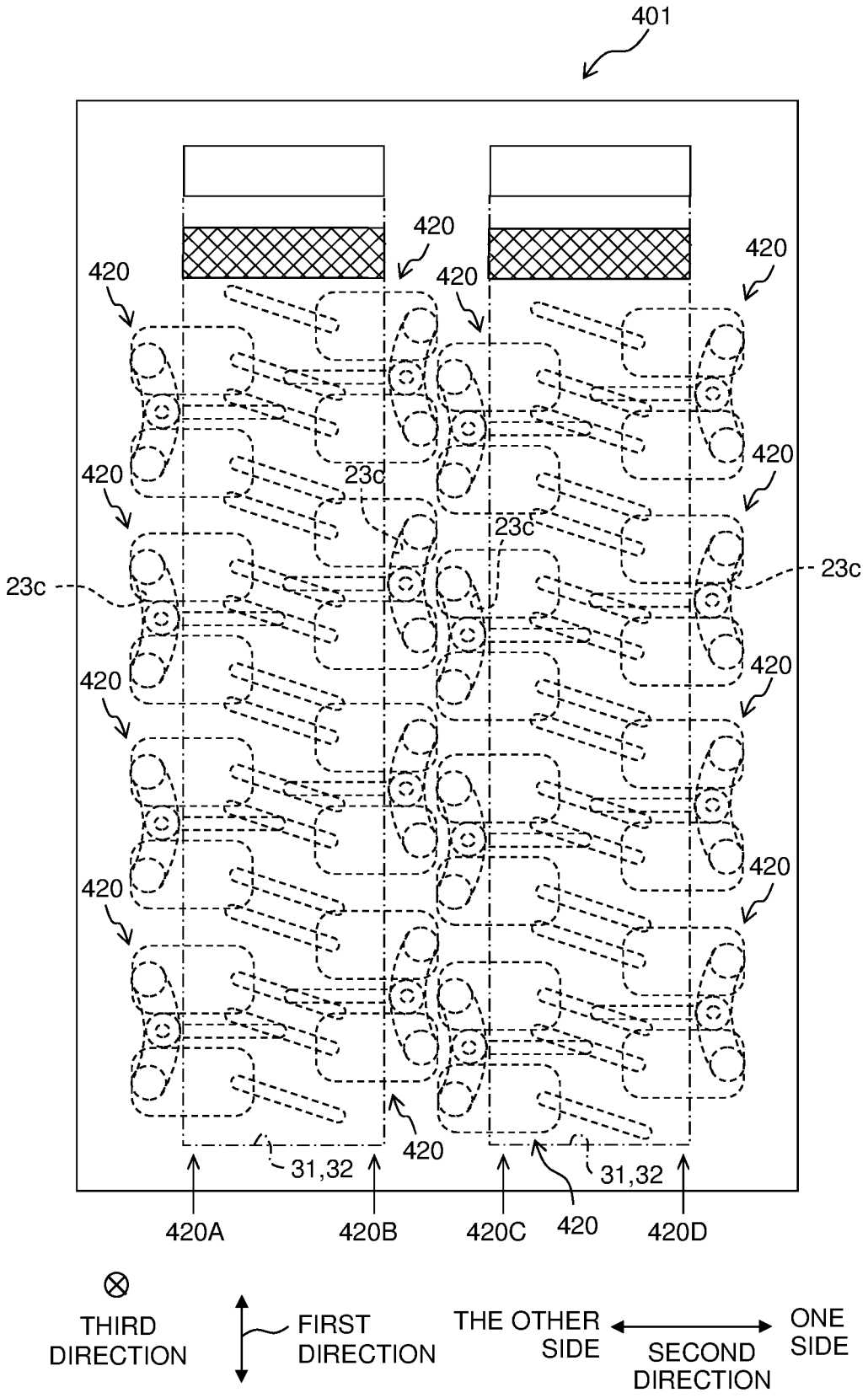
FIG. 9 is a plan view of a head according to a fourth embodiment of the present disclosure.

Next, a head 401 according to a fourth embodiment of the present disclosure will be explained, with reference to FIG. 9.

The head 1 of the first embodiment (FIG. 2) has the two individual channel groups 20A and 20B; and a set of the supply channel 31 and the return channel 32 which communicate with the two individual channel groups 20A and 20B and which are arranged side by side in the third direction. In the head 401 of the fourth embodiment (FIG. 9), however, has two individual channel groups 420A and 420B; a set of a supply channel 31 and a return channel 32 which communicate with the two individual channel groups 420A and 420B and which are arranged side by side in the third direction; two individual channel groups 420C and 420D; and a set of a supply channel 31 and a return channel 32 which communicate with the two individual channel groups 420C and 420D and which are arranged side by side in the third direction.

Each of the individual channel groups 420A to 420D is constructed of individual channels 420 included in a plurality of individual channels 420 and arranged side by side in the first direction. The four individual channel groups 420A to 420D are arranged side by side in the second direction. In the second direction, the individual channel groups 420B and 420C are positioned between the individual channel groups 420A and 420D.

Individual channels 420 belonging to the individual channel groups 420A and 420B and individual channels 420 belonging to the individual channel groups 420C and 420D communicate with mutually different supply channels 31, respectively, and communicate with mutually different return channels 32, respectively.

A linking part 23*c* of each of the individual channels 420 is curved in a plane orthogonal to the third direction. Specifically, the linking part 23*c* of each of the individual channels 420 belonging to the individual channel group 420A has a concave shape receding toward one side in the second direction; the linking part 23*c* of each of the individual channels 420 belonging to the individual channel group 420B has a concave shape receding toward the other side in the second direction; the linking part 23*c* of each of the individual channels 420 belonging to the individual channel group 420C has a concave shape receding toward the one side in the second direction; and the linking part 23*c* of each of the individual channels 420 belonging to the individual channel group 420D has a concave shape receding toward the other side in the second direction.

In the individual channel groups 420B and 420C, the linking parts 23*c* recede in a direction away from each other. Namely, the linking part 23*c* of each of the individual channels 420 belonging to the individual channel group 420B has a concave shape receding in a direction away from the individual channel group 420C in the second direction; and the linking part 23*c* of each of the individual channels 420 belonging to the individual channel group 420C has a concave shape receding in a direction away from the individual channel group 420B in the second direction. The individual channel group 420B corresponds to a "first individual channel group" of the present disclosure, and the individual channel group 420C corresponds to a "second individual channel group" of the present disclosure.

As described above, according to the fourth embodiment, although the fourth embodiment has the configuration of the channel different from that of the first embodiment, the fourth embodiment satisfies the requirement similar to that in the first embodiment. With this, the effects similar to those in the first embodiment can be achieved.

Further, in the fourth embodiment, the linking part 23*c* of each of the individual channels 420 belonging to the individual channel group 420B has the concave shape receding in the direction away from the individual channel group 420C in the second direction; and the linking part 23*c* of each of the individual channels 420 belonging to the individual channel group 420C has the concave shape receding in the direction away from the individual channel group 420B in the second direction. In this case, it is possible to arrange the individual channels 420 so that the distance in the second direction between the individual channel group 420B and the individual channel group 420C becomes to be 0 (zero), or that the individual channel group 420B and the individual channel group 420C partially overlap with each other in the first direction (for example, it is possible to insert one end of the linking part 23*c* of each of the individual channels 420 belonging to the individual channel group 420C into the concave part of the linking part 23*c* of each of the individual channels 420 belonging to the individual channel group 420B). Consequently, it is possible to realize the densification of the nozzles 21.

Fifth Embodiment

Figure 10:
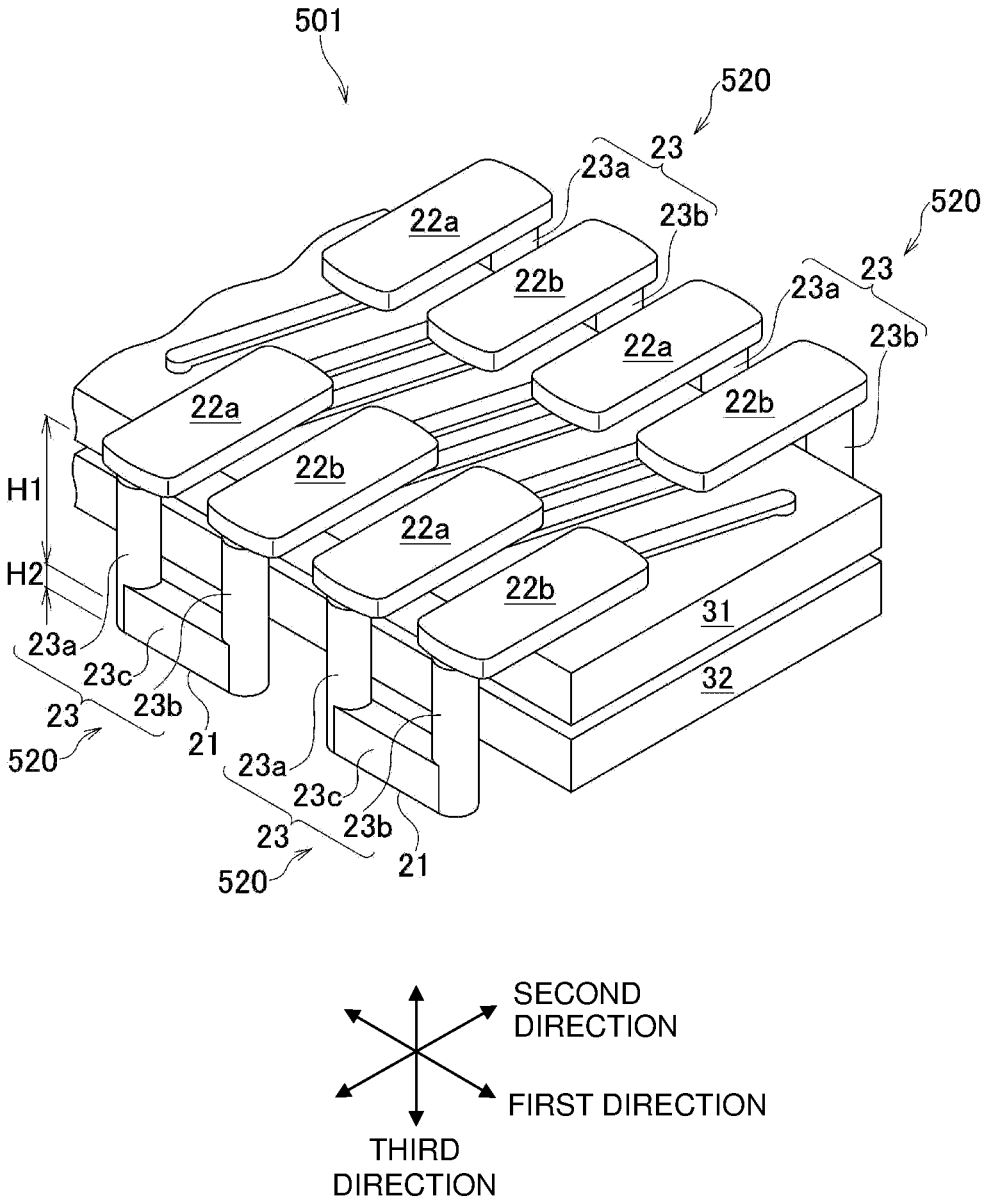
FIG. 10 is a perspective view of a head according to a fifth embodiment of the present disclosure, corresponding to FIG. 4.

Next, a head 501 according to a fifth embodiment of the present disclosure will be explained, with reference to FIG. 10.

In the fifth embodiment, connecting parts 23*a* and 23*b* of each of individual channels 520 are longer, in the third direction, than the connecting parts 23*a* and 23*b* (FIG. 4) in the first embodiment, and are longer, in the third direction, than an arrangement area in which the supply channel 31 and the return channel 32 are arranged.

In the first embodiment (FIG. 4), the connecting channel 23 has the extending part 23*d*. In the fifth embodiment, however, the connecting channel 23 does not have the extending part 23*d*, and the nozzle 21 is positioned at a location immediately below the linking part 23*c* (namely, any other channel is not interposed between the linking part 23*c* and the nozzle 21).

In the first embodiment (FIG. 4), the length H1 in the third direction from each of the first and second pressure chambers 22*a* and 22*b* to the linking part 23*c* is less than the length H2 in the third direction from the linking part 23*c* to the nozzle 21. Namely, the linking part 23*c* is positioned at an upper part of the area occupied by the connecting channel 23 (on the side closer to the first and second pressure chambers 22*a* and 22*b*).

In contrast, in the fifth embodiment (FIG. 10), the length H1 in the third direction from each of the first and second pressure chambers 22*a* and 22*b* to the linking part 23*c* is not less than the length H2 in the third direction from the linking part 23*c* to the nozzle 21. Namely, the linking part 23*c* is positioned at a lower part of the area occupied by the connecting channel 23 (on the side closer to the nozzle 21). Since the length in the third direction from each of the first and second pressure chambers 22*a* and 22*b* to the linking part 23*c* is long, the resistance in the connecting part 23 as a whole becomes small. With this, a circulation amount of the ink can be increased.

Sixth Embodiment

Figure 11:
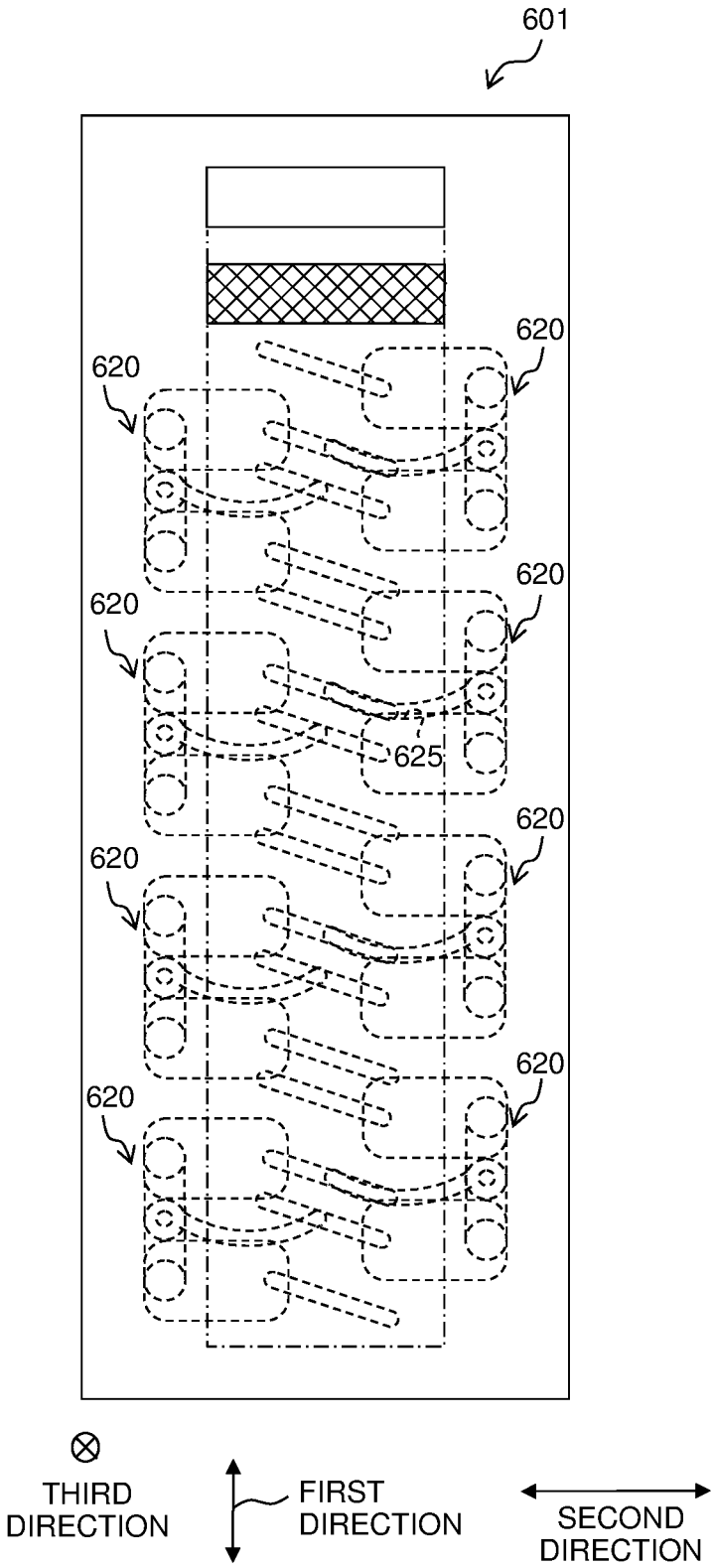
FIG. 11 is a plan view of a head according to a sixth embodiment of the present disclosure.

Next, a head 601 according to a sixth embodiment of the present disclosure will be explained, with reference to FIG. 11.

In the first embodiment (FIG. 2), the outflow channel 25 of each of the individual channels 20 extends linearly in the second direction. In the sixth embodiment (FIG. 11), however, an outflow channel 625 of each of individual channels 620 extends along a plane parallel to the first direction and the second direction (plane orthogonal to the third direction), and has a curved shaped in the above-described plane. In this case, it is possible to efficiently increase the resistance of the outflow channel 625. Consequently, the flow rate inside the outflow channel 625 is increased, which in turn makes it possible to smoothly discharge (exhaust) the air, which has entered into the individual channel 620, via the outflow channel 625.

Seventh Embodiment

Figure 12:
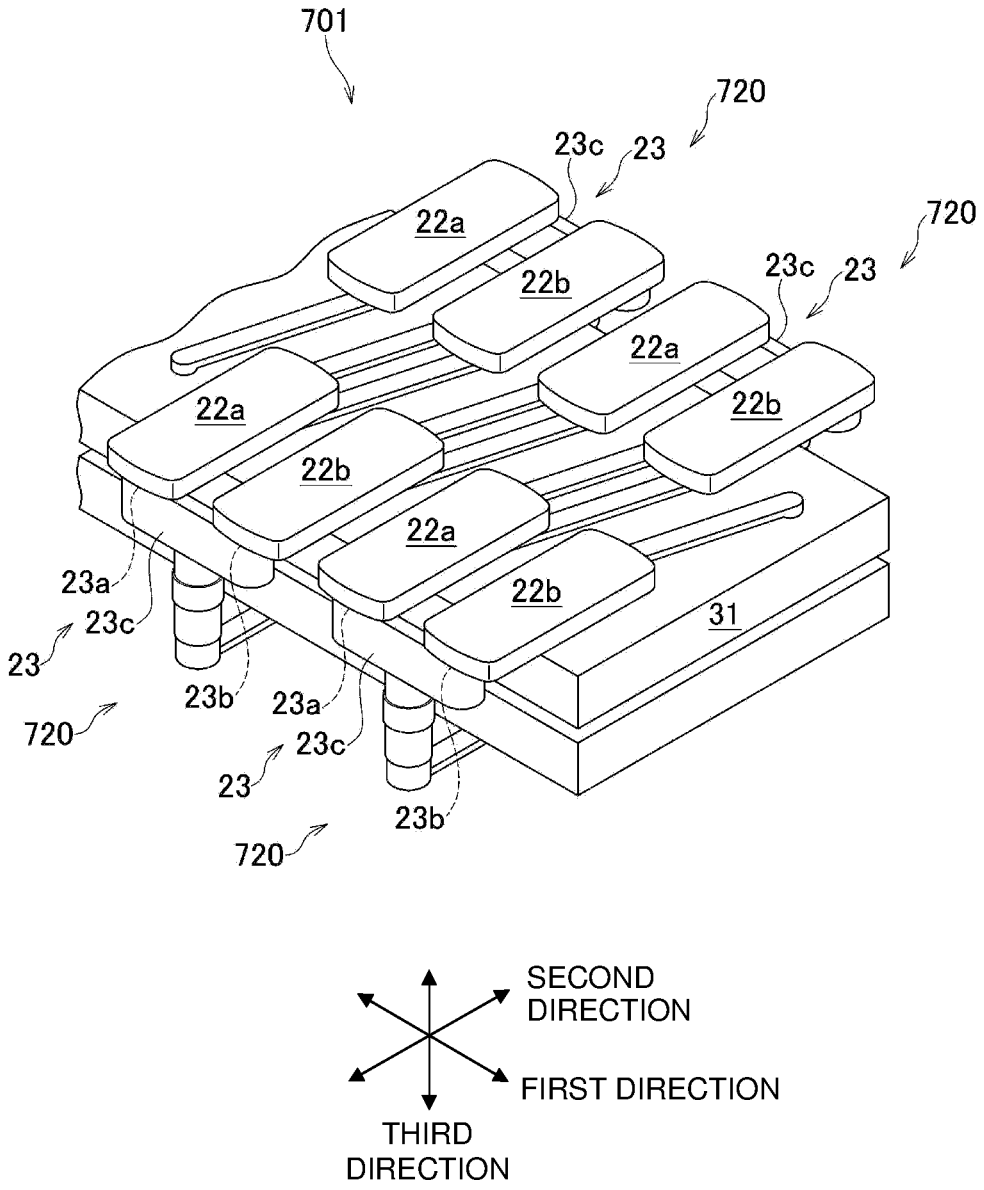
FIG. 12 is a perspective view depicting a part of a channel formed in the inside of a head according to a seventh embodiment of the present disclosure, corresponding to FIG. 4.

Next, a head 701 according to a seventh embodiment of the present disclosure will be explained, with reference to FIG. 12.

In the first embodiment (FIG. 4), the first and second connecting parts 23*a* and 23*b* of each of the individual channels 20 are the columnar-shaped channels extending downward from the first and second pressure chambers 22*a* and 22*b*, respectively. In the seventh embodiment (FIG. 12), however, each of first and second connecting parts 23*a* and 23*b* of one of individual channels 720 is constructed of an interface between the linking part 23*c* and one of the first and second pressure chambers 22*a* and 22*b* (an opening formed in the lower surface of each of the first and second pressure chambers 22*a* and 22*b*). (Namely, in the seventh embodiment, the linking part 23*c* is positioned at a location immediately below the pressure chambers 22*a* and 22*b*. Namely, any other channel such as a columnar-shaped channel, etc., is not interposed between the linking part 23*c* and each of the first and second pressure chambers 22*a* and 22*b*.)

According to the seventh embodiment, although the seventh embodiment has the configuration of the connecting channel 23 different from that of the first embodiment, the seventh embodiment satisfies the requirement (the same common channel (supply channel 31) communicates with the first pressure chamber 22*a* and the second pressure chamber 22*b* of each of the individual channels 720, etc.) similar to that in the first embodiment. With this, the effects similar to those in the first embodiment can be achieved.

[Modifications]

In the foregoing, the embodiments of the present disclosure have been explained. The present disclosure, however, is not limited to or restricted by the above-described embodiments; it is allowable to make a various kind of design changes to the present disclosure, within the scope described in the claims.

In the above-described embodiments, the first common channel is the supply channel, and the second common channel is the return channel. The present disclosure, however, is not limited to or restricted by this configuration. For example, it is allowable that the first common channel is the return channel, and the second common channel is the supply channel. Alternatively, it is allowable that both the first common channel and the second common channel are supply channels. Namely, in the present disclosure, the direction of flow of the liquid in the first and second common channels is not particularly limited. It is similarly applicable also to the third common channel in the third embodiment, and the third common channel may be either one of the supply channel and the return channel.

It is allowable that a filter is provided on the second common channel. It is allowable that any filter is not provided on the first channel.

The third embodiment (FIG. 7) is not limited to the configuration wherein the one end 320*a* and the other end 320*b* of each of the individual channels 320 are arranged at the mutually same positions, respectively, in the first direction; it is also allowable that the one end 320*a* and the other end 320*b* of each of the individual channels 320 are arranged at mutually different positions, respectively, in the first direction.

It is allowable that any damper is not provided on the first to third common channels.

The nozzle is not limited to being positioned at the center in the longitudinal direction of the linking part; it is allowable that the nozzle is positioned at any position in the longitudinal direction of the linking part (for example, at one end or the other end in the longitudinal direction of the linking part).

Although the number of the nozzle belonging to each of the individual channels is 1 (one) in the above-described embodiments, it is allowable that the number of nozzle belonging to each of the individual channels may be not less than 2 (two).

The liquid discharging head is not limited to being the head of the line system; it is allowable that the liquid discharging head is a head of a serial system (a system in which the head discharges a liquid from a nozzle toward an object or target of discharge, while the head moves in a scanning direction parallel to the sheet width direction).

The object of discharge is not limited to being a sheet; the object of discharge may be, for example, cloth (fabric), substrate, etc.

The liquid discharged (dischargeable) from the nozzle is not limited to being the ink; it is allowable that the liquid is any liquid (for example, a treating liquid causing a component in the ink to aggregate or deposit; etc.).

The present disclosure is not limited to being applicable to the printer; the present disclosure is applicable also to a facsimile machine, copying machine, a multifunction peripheral, etc. Further, the present disclosure is also applicable to a liquid discharging apparatus usable for a usage different from recording of an image (for example, a liquid discharging apparatus configured to discharge a conductive liquid onto a substrate so as to form a conductive pattern), etc.

What is claimed is:

1. A liquid discharging head comprising:

individual channels aligned in a first direction; and a first common channel and a second common channel extending in the first direction, the size, in the first direction, of the first common channel being larger than the size, in a second direction being perpendicular to the first direction, of the first common channel, the size, in the first direction, of the second common channel being larger than the size, in the second direction, of the second common channel, wherein each of the individual channels includes: a nozzle; a first pressure chamber and a second pressure chamber arranged side by side in the first direction; and a connecting channel connecting the nozzle, the first pressure chamber and the second pressure chamber to one another, the first pressure chamber and the second pressure chamber being provided with a first actuator and a second actuator thereon, respectively, the first common channel communicates with the first and second pressure chambers, and the second common channel communicates with the connecting channel.

2. The liquid discharging head according to claim 1, further comprising:

a first individual channel group constructed of individual channels included in the individual channels; and a second individual channel group constructed of individual channels included in the individual channels, and arranged side by side to the first individual channel group in the second direction, the second direction being a width direction of the first and second common channels, wherein the connecting channel includes:

a first connecting part connected to the first pressure chamber;

a second connecting part connected to the second pressure chamber; and a linking part linking the first connecting part and the second connecting part to each other and extending along a plane parallel to the first direction and the second direction, and the nozzle is positioned on a side opposite to the first and second pressure chambers, with respect to the linking part, in a third direction which is a height direction of the first and second common channels.

3. The liquid discharging head according to claim 2, wherein in the first individual channel group, the linking part has a concave shape receding away from the second individual channel group in the second direction, and in the second individual channel group, the linking part has a concave shape receding away from the first individual channel group in the second direction.

4. The liquid discharging head according to claim 1, wherein the connecting channel includes:

a first connecting part connected to the first pressure chamber;

a second connecting part connected to the second pressure chamber; and a linking part linking the first connecting part and the second connecting part to each other and extending along a plane parallel to the first direction and the second direction, the second direction being a width direction of the first and second common channels, the nozzle is positioned on a side opposite to the first and second pressure chambers, with respect to the linking part, in a third direction which is a height direction of the first and second common channels, and a length in the third direction from each of the first and second pressure chambers to the linking part is less than a length in the third direction from the linking part to the nozzle.

5. The liquid discharging head according to claim 1, wherein the connecting channel includes:

a first connecting part connected to the first pressure chamber;

a second connecting part connected to the second pressure chamber; and a linking part linking the first connecting part and the second connecting part to each other and extending along a plane parallel to the first direction and the second direction, the second direction being a width direction of the first and second common channels, the nozzle is positioned on a side opposite to the first and second pressure chambers, with respect to the linking part, in a third direction which is a height direction of the first and second common channels, and a length in the third direction from each of the first and second pressure chambers to the linking part is not less than a length in the third direction from the linking part to the nozzle.

6. The liquid discharging head according to claim 1, wherein each of the individual channels includes a communicating channel which communicates the connecting channel to the second common channel, the communicating channel has a part extending along a plane parallel to the first direction and the second direction, the second direction being a width direction of the first and second common channels, and the part has a curved shape in the plane.

7. The liquid discharging head according to claim 1, wherein a filter is provided on the first common channel, and no filter is provided on the second common channel.

8. A liquid discharging head comprising:

individual channels aligned in a first direction; and a first common channel, a second common channel and a third common channel which extend in the first direction, wherein the first common channel, the second common channel and the third common channel are arranged side by side in a second direction which is a width direction of the first to third common channels, the second common channel being positioned between the first and third common channels in the second direction, each of the individual channels includes a nozzle, a first pressure chamber and a second pressure chamber arranged side by side in the second direction, and a connecting channel connecting the nozzle, the first pressure chamber and the second pressure chamber to one another, the first pressure chamber and the second pressure chamber being provided with a first actuator and a second actuator thereon, respectively, the first common channel communicates with the first pressure chamber, the second common channel communicates with the connecting channel, and the third common channel communicates with the second pressure chamber.

9. The liquid discharging head according to claim 8, wherein an opening of the first common channel and an opening of the third common channel are formed on a same side in the first direction with respect to the individual channels, and in at least any one of the individual channels, an end communicated with the first common channel and the other end communicated with the third common channel are located at mutually same positions, in the first direction.

10. The liquid discharging head according to claim 8, wherein the connecting channel includes:

a first connecting part connected to the first pressure chamber;

a second connecting part connected to the second pressure chamber; and a linking part linking the first connecting part and the second connecting part to each other and extending along a horizontal plane parallel to the first direction and the second direction, the nozzle is positioned at a location below the linking part, and the second common channel is positioned at a location above the linking part, each of the individual channels includes a communicating channel communicating the connecting channel and the second common channel with each other, and the communicating channel extends upward from the linking part and reaches the second common channel.

11. The liquid discharging head according to claim 10, wherein the nozzle is positioned at a location immediately below the linking part.

12. The liquid discharging head according to claim 10, wherein the nozzle overlaps with the communicating channel in a vertical direction.

13. The liquid discharging head according to claim 8, wherein a filter is provided on each of the first common channel and the third common channel, and no filter is provided on the second common channel.

14. The liquid discharging head according to claim 8, wherein a first damper is provided on each of the first common channel and the third common channel.

15. The liquid discharging head according to claim 14, wherein a second damper is provided on the second common channel, each of the individual channels includes a joining channel joining the first pressure chamber to the first common channel, and the second damper is defined by a plate constructing the joining channel.

* * * * *